US009903146B2

(12) United States Patent
Nordieker

(10) Patent No.: US 9,903,146 B2
(45) Date of Patent: Feb. 27, 2018

(54) BEARING ARRANGEMENT FOR A DOOR

(71) Applicant: HETTICH-ONI GMBH & CO. KG, Vlotho (DE)

(72) Inventor: Martin Nordieker, Hullhorst (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 19 days.

(21) Appl. No.: 15/118,317

(22) PCT Filed: Feb. 11, 2015

(86) PCT No.: PCT/EP2015/052808
§ 371 (c)(1),
(2) Date: Aug. 11, 2016

(87) PCT Pub. No.: WO2015/121271
PCT Pub. Date: Aug. 20, 2015

(65) Prior Publication Data

US 2017/0175429 A1 Jun. 22, 2017

(30) Foreign Application Priority Data

Feb. 13, 2014 (DE) ..... 10 2014 101 849

(51) Int. Cl.
*E05F 1/12* (2006.01)
*E05F 3/10* (2006.01)
(Continued)

(52) U.S. Cl.
CPC ..... *E05F 1/12* (2013.01); *E05F 3/104* (2013.01); *E05F 3/22* (2013.01); *E05F 5/00* (2013.01);
(Continued)

(58) Field of Classification Search
CPC ..... E05F 1/12; E05F 3/104; E05F 3/22
(Continued)

(56) References Cited

U.S. PATENT DOCUMENTS 2,603,818 A * 7/1952 Carlson ..... E05F 3/10 16/229
3,273,196 A * 9/1966 Voster ..... E05F 3/104 16/55
(Continued)

FOREIGN PATENT DOCUMENTS

DE 2522410 1/1977
DE 2620386 11/1977
(Continued)

OTHER PUBLICATIONS

Search Report issued in Int'l App. No. PCT/EP2015/052808 (dated 2015).
(Continued)

*Primary Examiner* — Jeffrey O'Brien
(74) *Attorney, Agent, or Firm* — Barnes & Thornburg LLP

(57) ABSTRACT

A bearing arrangement for a door, in particular for refrigerators or freezers, comprises a bearing pin for rotatably bearing the door, a closing device by means of which the door can be moved over a certain pivoting region in the closing direction through the force of a force accumulator, and a damper for damping a pivoting movement of the door over at least one pivoting region, and the closing device and the damper are oriented in a substantially perpendicular plane with respect to the axis of rotation of the bearing pin, wherein, to move the closing device, a first curved guide which can be moved by the bearing pin is provided and, to move the damper, a second curved guide which can be moved by the bearing pin is provided. As a result, the bearing arrangement can have a particularly compact design, the bearing arrangement being used in particular in a refrigerator or freezer.

18 Claims, 9 Drawing Sheets

(51) Int. Cl.
*E05F 3/22* (2006.01)
*E05F 5/00* (2017.01)

(52) U.S. Cl.
CPC ..... *E05Y 2201/626* (2013.01); *E05Y 2600/41* (2013.01); *E05Y 2900/132* (2013.01)

(58) Field of Classification Search
USPC ..... 16/378, 50, 63, 65, 54, 55, 68
See application file for complete search history.

(56) References Cited

U.S. PATENT DOCUMENTS

| | | | | | |
|---|---|---|---|---|---|
| 3,668,737 | A * | 6/1972 | Tillmann | E05F 3/104 | 16/312 |
| 3,760,455 | A * | 9/1973 | Berry | E05F 3/104 | 16/51 |
| 3,773,311 | A | 11/1973 | Poe et al. | | |
| 3,838,477 | A * | 10/1974 | Evans | E05F 3/104 | 16/55 |
| 4,067,084 | A * | 1/1978 | Tillmann | E05F 3/223 | 16/51 |
| 9,702,177 | B2 * | 7/2017 | Bacchetti | E05F 3/104 | |
| 2012/0117755 | A1 * | 5/2012 | Walhorn | E05F 3/104 | 16/66 |

FOREIGN PATENT DOCUMENTS

| | | | |
|---|---|---|---|
| DE | 202006010482 | U1 | 11/2007 |
| DE | 202007005957 | U1 | 6/2008 |
| GB | 1282253 | | 7/1972 |

OTHER PUBLICATIONS

Search Report issued in German App. No. 102014101849.4 (dated 2014).

* cited by examiner

BEARING ARRANGEMENT FOR A DOOR

This application is a U.S. nationalization under 35 U.S.C. § 371 of International Application No. PCT/EP2015/052808, filed Feb. 11, 2015, which claims priority to German Patent Application No. 10 2014 101 849.4, filed Feb. 13, 2014. The disclosures set forth in the referenced applications are incorporated herein by reference in their entireties.

BACKGROUND AND SUMMARY OF THE DISCLOSURE

The present disclosure relates to a bearing arrangement for a door, for example, for refrigerators, having a bearing axis for the rotatable mounting of the door, a closing device, by means of which the door is movable in the closing direction by the force of a spring over a specific pivot range, and a damper for damping a pivot movement of the door over at least one pivot range.

DE 20 2006 010 482 U1 discloses an arrangement for the pivotable mounting of a door of a refrigerator or freezer. The pivotable door is coupled to a lever to which a closing device and a damping device are actuated. The closing device and the damping device may be actuated via a pivotable component, which is moved by the door over a specific pivot range. The rigid coupling of the damping device to the closing device via the pivot part has the disadvantage that flexible adaptation of the damping forces or closing forces to the door cannot be performed. In addition, only comparatively small damping forces and closing forces can be caused.

The present disclosure illustrates and describes a bearing arrangement for a door which, using a closing device and a damper, can be flexibly adapted to the respective intended use with regard to the damping forces and closing forces.

According to the disclosure, a first curve guide, which is movable by the bearing axis, is provided for moving the closing device, and a second curve guide, which is movable by the bearing axis, is provided for moving the damper. The curve guides can have corresponding control projections, which act on the closing device and/or on the damper. Two separate curve guides can be used for the closing device and the damper. It is also possible to provide a single curve guide which acts both on the closing device and also the curve guide. Due to the use of curve guides, the forces for closing or damping can be set more accurately, since rigid coupling is no longer provided between the door and the closing device and the damper. Instead, the coupling takes place via curve guides, which act on the closing device and the damper during pivoting of the door. Both the closing device and also the damper can be pre-tensioned in this case by a spring against the curve guide.

The first and the second curve guide may be connected in a rotationally-fixed manner to the bearing axis, so that a particularly compact construction is possible. The first and second curve guides can be arranged offset in relation to one another in the axial direction or can be formed by a single disk, on which control projections are formed.

According to an embodiment, the second curve guide actuates the damper for damping the door both in the closing direction before reaching the closing position and also in the opening direction before reaching the maximum open position. A single damper can thus be used to provide a closing damping and additionally an opening damping. The damper is actuated by corresponding control projections on the second control curve, wherein the opening damping takes place before reaching the maximum opening position, which can be in a range between 90° and 180°, for example. The opening damping and the closing damping can extend in this case over a pivot range of the door of at least 5° in each case, for example during the closing damping between 10° and 50° before the closing position and during the opening damping between 5° and 25° before the maximum opening position.

For a compact construction, the closing device and the damper may be provided in a housing, which can alternately be installed inside or outside a refrigerator.

The damper may be designed as a linear compression damper, which causes a higher damping force during compression than during expansion. The damper can thus provide high braking forces during a closing or opening damping, but not be noticed or be barely noticed by the user during a movement in the opposite direction. Alternatively, a traction or rotation damper can be used instead of a compression damper.

The damper may be mounted at one side on the housing so it is rotatable and may be held so it is rotatable on a pivot part on the opposite side. The second curve guide can have control projections, which act on the pivot part and/or a roller arranged on the pivot part, to actuate the damper during a movement of the door.

The closing device may have a compression spring, which is tensioned between two end pieces. One end piece may be mounted so it is rotatable on the housing and the opposing end piece may be mounted on a rotatably mounted actuating part. The rotatably mounted actuating part can then be moved via at least one control projection on the first curve guide, wherein a rotatable roller can also be provided on the actuating part, on which the at least one control projection acts.

The actuating part for moving the closing device can be rotated in this case independently of the pivot part for actuating the damper, wherein pivot part and actuating part may be mounted on the housing so they are rotatable about the same axis.

Furthermore, a catch mechanism may be provided to latch the closing device in a tensioned state when the door is open. It is thus possible, after the tensioning of the closing device, to move the door in a free motion, without friction or braking forces acting due to the closing device. The catch mechanism can have a catch pawl actuable by a control curve, wherein the catch pawl may be pre-tensioned by a spring in the position which releases the latching. This prevents blocking of the door from occurring unintentionally due to the blocking pawl. In addition, the catch mechanism may enable a compact construction, because the closing device is only moved over a part of the pivot path of the door, so that structural space only has to be provided for this movement range.

The forces of the closing device and the damper may act in a plane essentially perpendicular in relation to the axis of rotation of the bearing axis. The bearing axis may be aligned essentially vertically, while the forces of the damper and the closing device act essentially horizontally in the installed state. A particularly flat construction of the bearing arrangement thus results.

The bearing arrangement according to the disclosure can be used in particular for domestic appliances, for example, for refrigerators or freezers. In addition, of course, a use for furniture or other domestic appliances is also possible.

DETAILED DESCRIPTION OF ILLUSTRATIVE EMBODIMENTS

Figure 1:
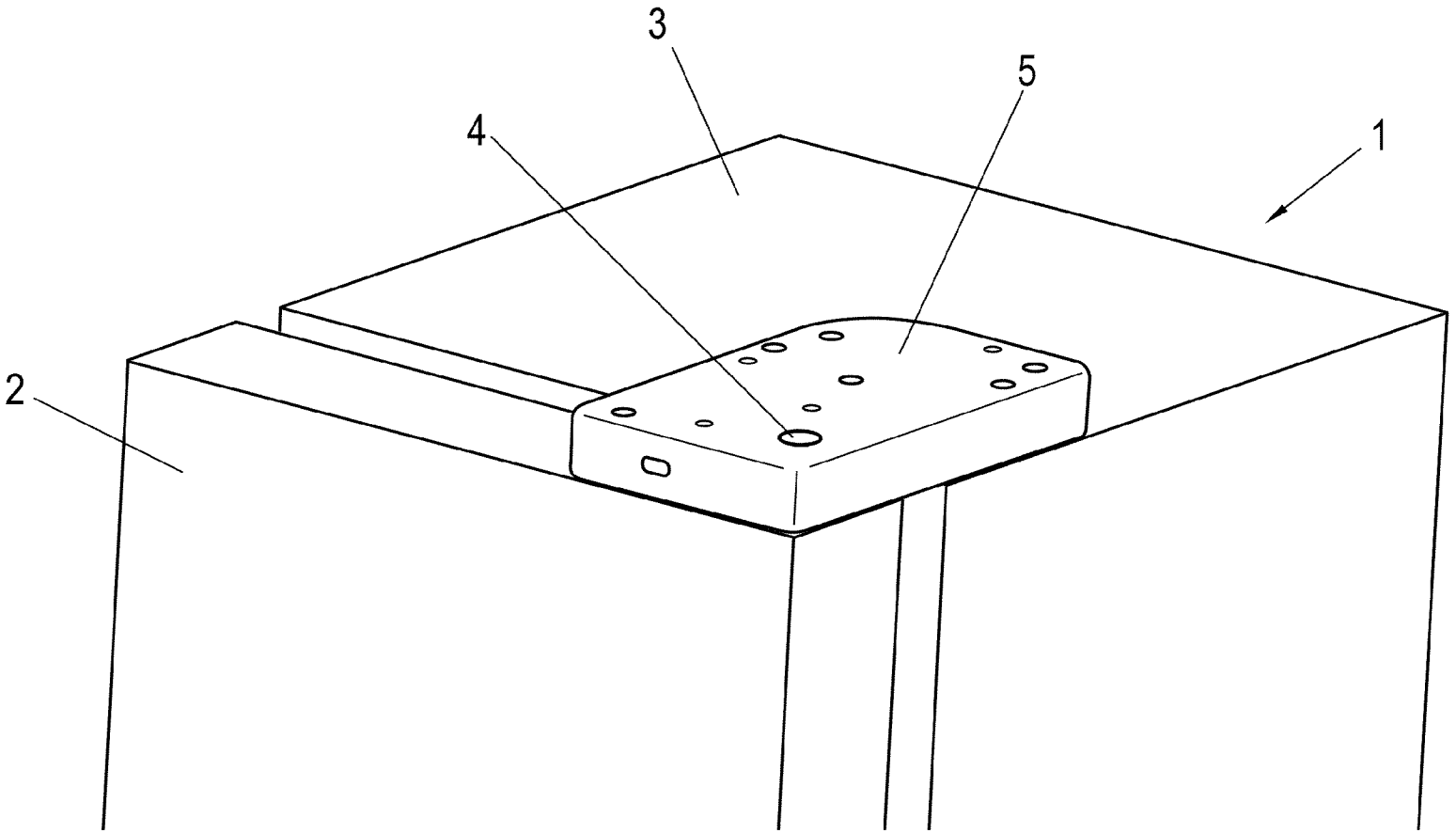
FIG. 1 shows a perspective view of a refrigerator having a bearing arrangement according to the invention.

A refrigerator 1 comprises a cabinet 3, on which a door 2 is mounted so it is rotatable. For this purpose, a housing 5 having a bearing arrangement is fixed on the upper side of the cabinet 3. The bearing arrangement comprises in this case a bearing axis 4, which is mounted so it is rotatable in the housing and on which the door 2 is fixed so it is rotatable. In FIG. 1, the housing 5 having the bearing arrangement is fixed on the upper side of the cabinet 3. However, it is also possible to provide the bearing arrangement with the housing 5 on the lower side of the cabinet 3. In an alternative embodiment, a bearing arrangement is also arranged inside the cabinet 3, wherein mounting on the outer side has the advantage that retrofitting is possible in existing refrigerators.

Figure 2:
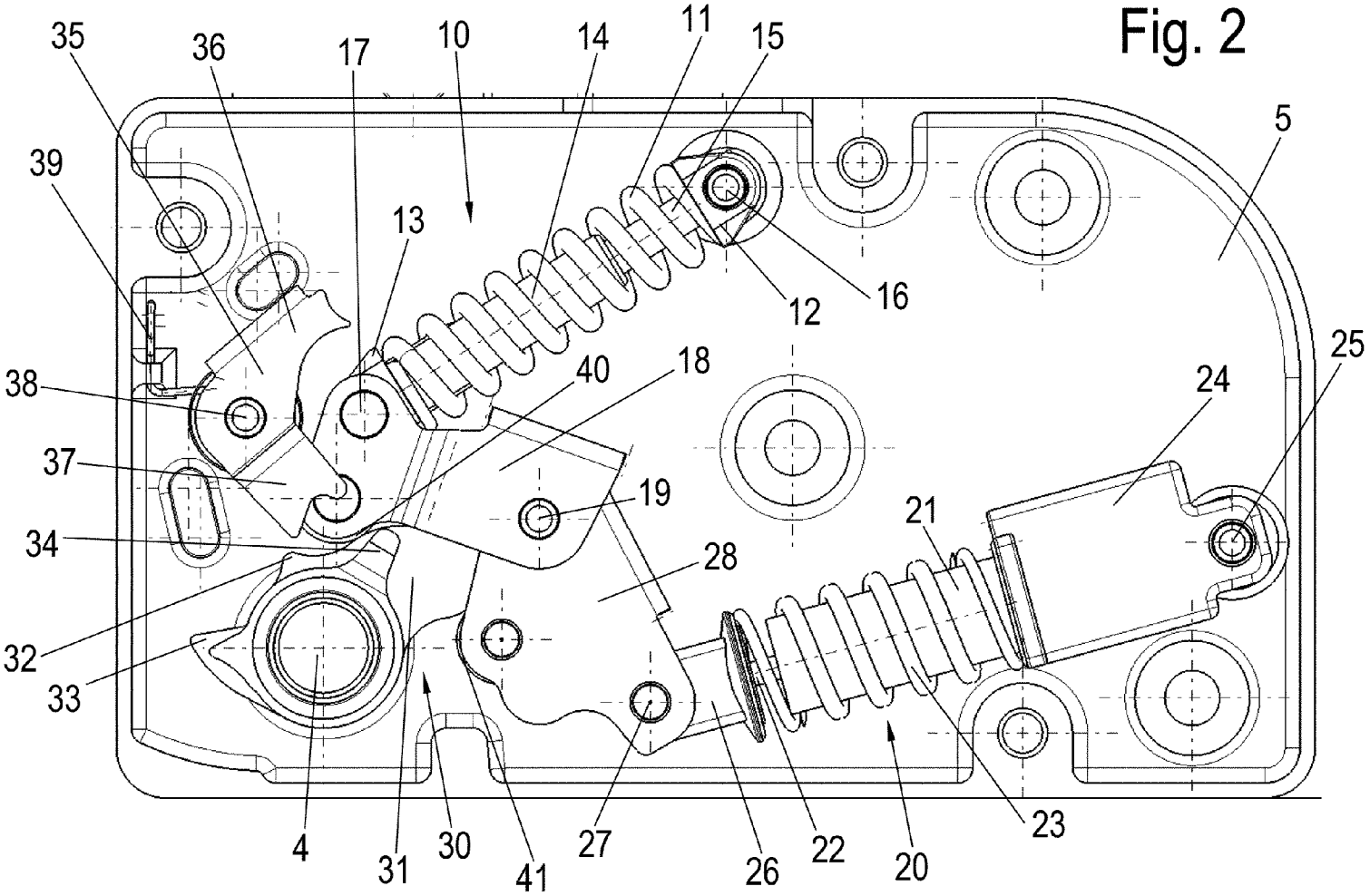
FIG. 2 shows a view of the bearing arrangement with a closed door.

In FIG. 2, the housing 5 of the bearing arrangement is shown with a cover of the housing 5 removed so that a closing device 10 and a damper 20 are visible.

The closing device 10 comprises a spring 11, in the form of a compression spring, which is tensioned between two end pieces 12 and 13. A first end piece 12 is mounted on the housing 5 so it is rotatable about an axis 16. On the opposing side, the end piece 13 is mounted about an axis 17, which is arranged on a rotatable actuating part 18. The rotatable actuating part 18 is mounted on the housing 5 so it is rotatable about the axis 19. The spring 11 is guided about a sleeve 14, which can be pushed onto a rod 15, to be able to perform a length compensation between the two end pieces 12 and 13.

Furthermore, a damper 20 is provided in the housing 5, which is formed as a linear compression damper having a housing 21 and a piston rod 22. The piston rod 22 is insertable into the housing 21, wherein high damping forces are provided during the insertion of the piston rod 22 via a corresponding piston, while the retraction of the piston rod 22 takes place smoothly. The housing 21 is fixed on a holder 24, which is mounted on the housing 5 so it is rotatable about an axis 25. The piston rod 22 is connected at the opposite side via a holder 26 to a pivot part 28, wherein the holder 26 is mounted so it is rotatable about an axis 27. The pivot part 28 is mounted so it is rotatable about the axis 19 on the housing 5, on which the actuating part 18 is also mounted, wherein the actuating part 18 and the pivot part 28 can be rotated independently of one another about the axis 19.

For actuation of the closing device 10 and the damper 20, a curve guide 30 is provided, which is arranged in a rotationally fixed manner on the bearing axis 4. The curve guide 30 comprises multiple control projections 31, 32, and 33, which act on the actuating part 18 and the pivot part 28. For this purpose, a roller 40 is mounted so it is rotatable on the actuating part 18, while a roller 41 is held so it is rotatable on the pivot part 28. Alternatively, the rollers can also be replaced by sliding elements, so that a sequence which is as low friction as possible is ensured between the control projections and the actuating part or pivot part 28.

Furthermore, a catch mechanism is also provided in the housing 5, to latch the closing device 10 in a tensioned position, wherein the catch mechanism comprises a pivotable catch pawl 35, which is mounted on the housing 5 so it is rotatable about the axis 38.

Figure 3:
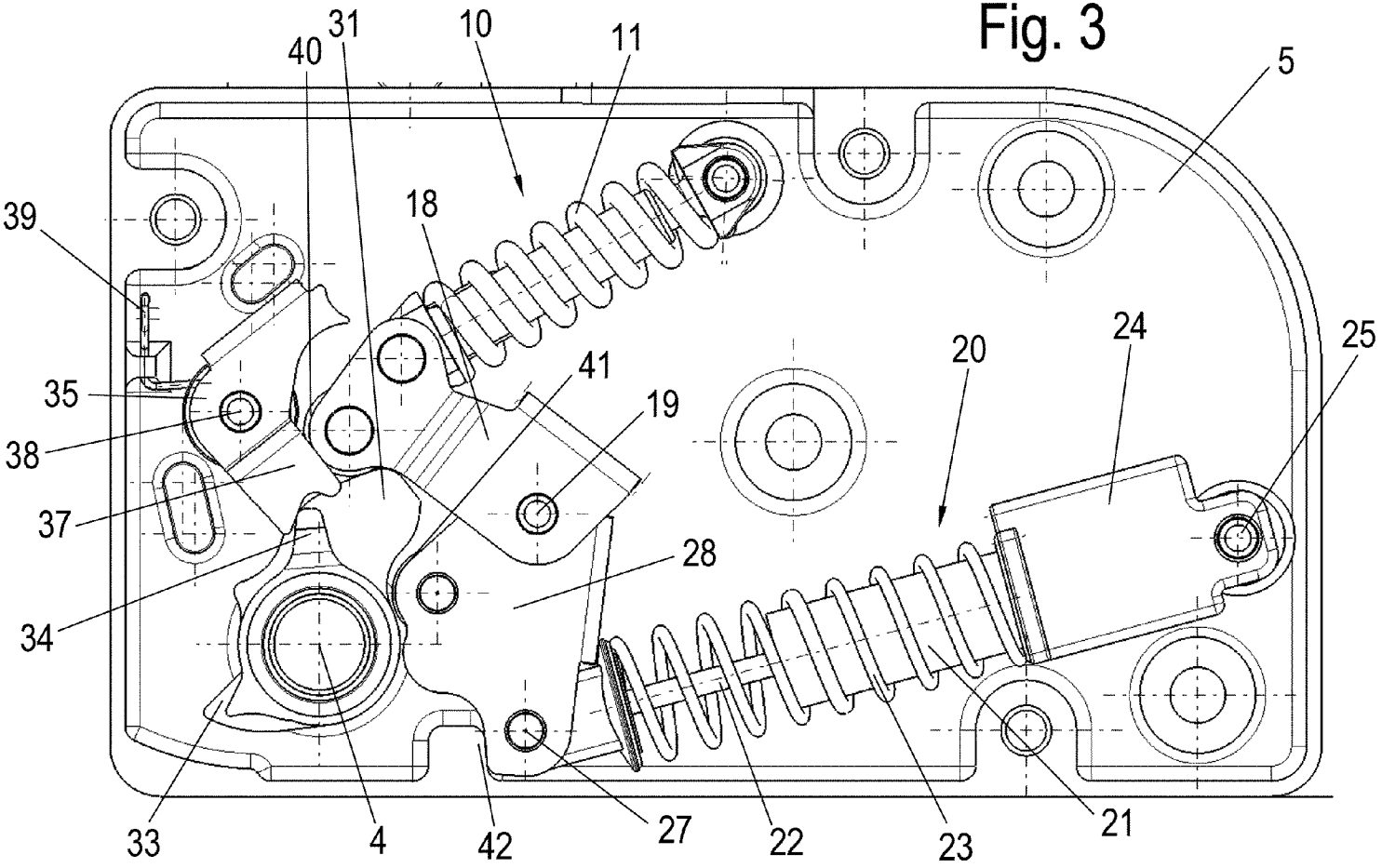
FIG. 3 shows a view of the bearing arrangement with the door open at a 35° angle.

If the door 2 is opened from the closed position, as shown in FIG. 3, the bearing axis 4 thus rotates the curve guide 30 counterclockwise, so that the first control projection 31 acts on the roller 40, to tension the spring 11 of the closing device 10. At the same time, in the pivot range between the closing position and an opening angle of between 20° and 60°, the damper 20 is released, and the control projection 31 is rotated, whereby the pivot part 28 rotates clockwise about the axis 19, until the pivot part 28 comes into contact on a stop 42 of the housing. The withdrawal of the piston rod 22 out of the housing 21 and the pivoting of the pivot part 28 linked thereto take place by means of the force of a spring 23, which is arranged between the holder 26 and the holder 24.

Figure 4:
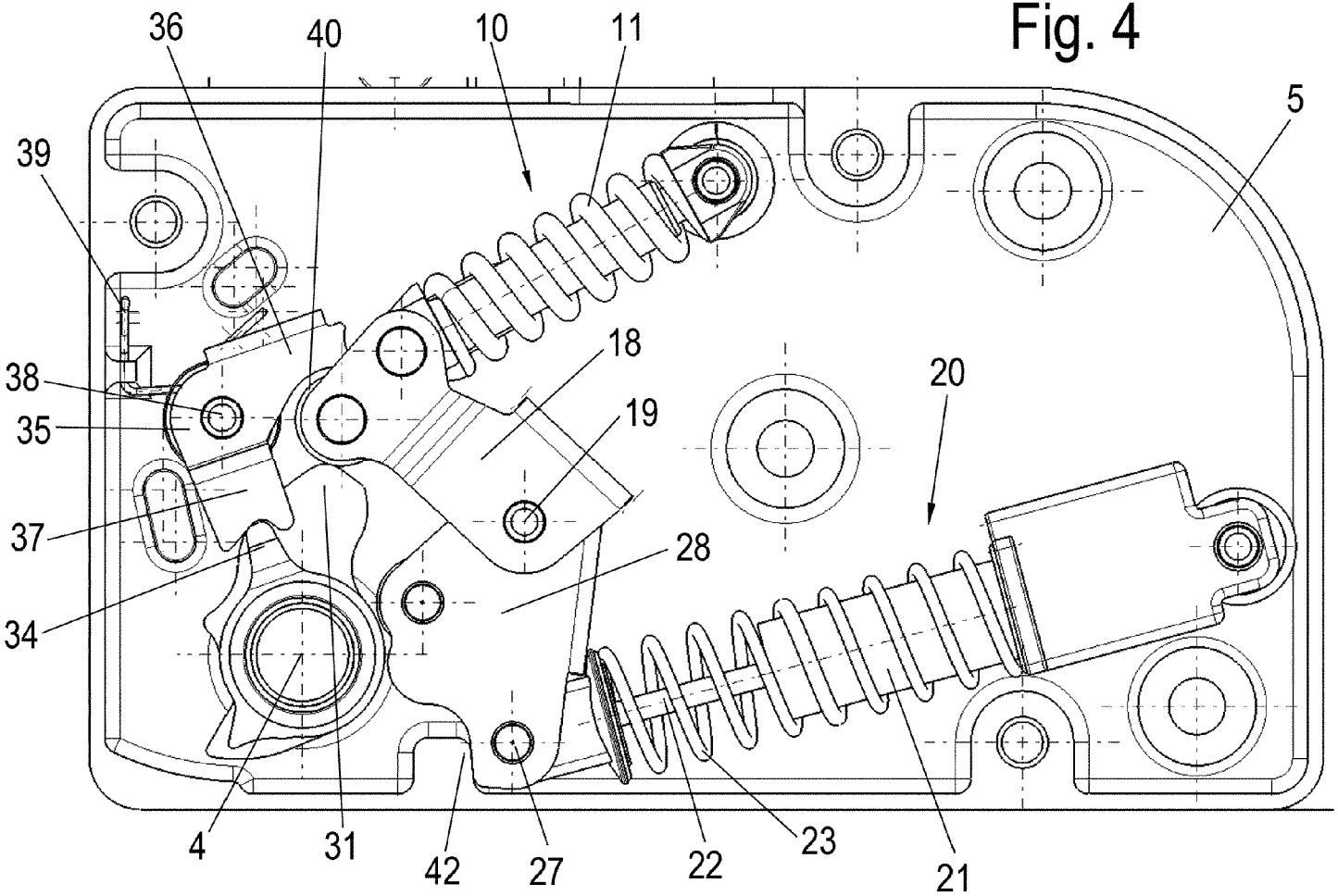
FIG. 4 shows a view of the bearing arrangement with the door open at a 50° angle.

In FIG. 4, the door 2 is arranged remote from the closed position in an angle position of approximately 50°. The damper 20 between the holder 24 and the holder 26 initially does not change its location when the closing device 10 is tensioned further, in that the control projection 31 acts on the roller 40 and at the same time rotates the actuating part 18 further clockwise, to compress the spring 11 of the closing device 10.

Upon opening of the door between an opening angle of 35° (FIG. 3) and 50° (FIG. 4), a control curve 34 of the catch mechanism additionally engages with an arm 37 of the catch pawl 35, so that it is rotated about the axis 38. A second arm 36 of the catch pawl 35, which is formed as essentially V-shaped, is thus pivoted in relation to the actuating part 18. The control curve 34 rotates the catch pawl 35 against the force of a spring 39 in this case, which pre-tensions the catch pawl 35 in the unlocked position.

Figure 5:
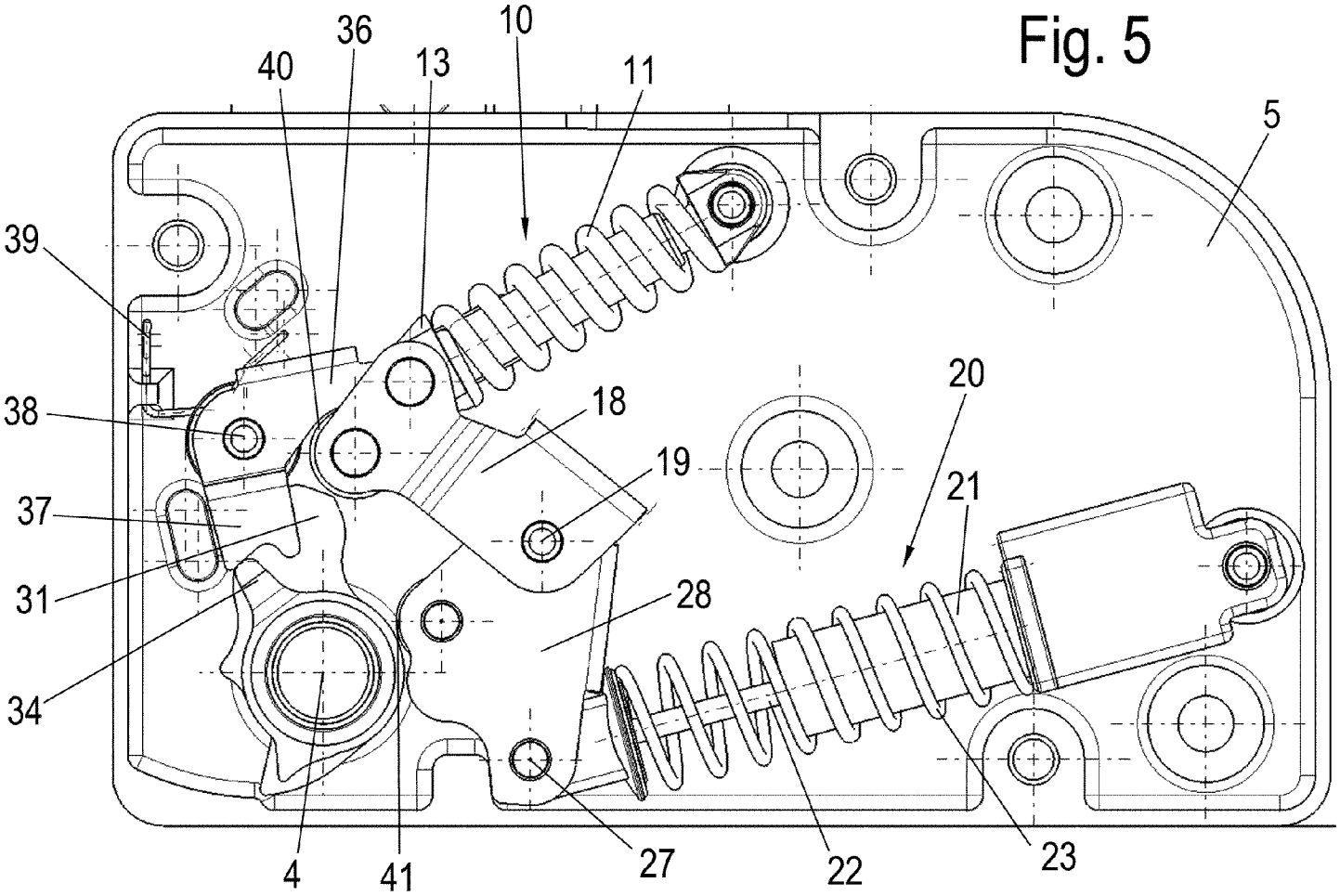
FIG. 5 shows a view of the bearing arrangement with the door open at a 67° angle.

If the door 2 is now pivoted further in the opening direction, it passes through the position shown in FIG. 5, at which the arm 36 engages with the end piece 13, to latch the closing device 10. The control curve 34 now leaves the arm 37, wherein the control projection 31 is formed so that the spring 11 relaxes slightly upon the latching, to latch on the arm 36, so that the roller 40 can be lifted off of the control projection 31.

Figure 6:
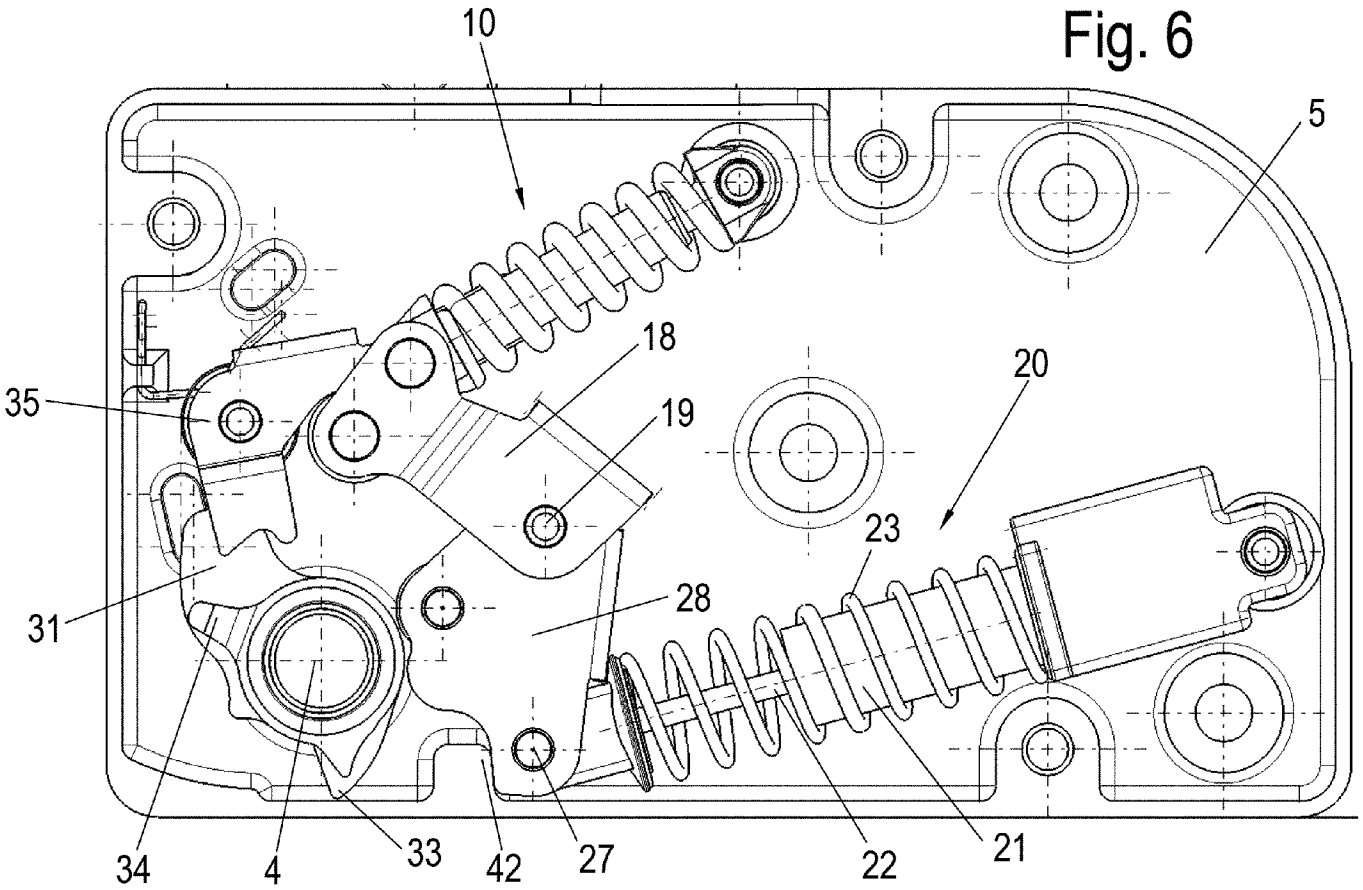
FIG. 6 shows a view of the bearing arrangement with the door open at a 100° angle.

If the door 2 is now moved further in the opening direction, for example, up to an opening angle of approximately 100° (FIG. 6), the door 2 moves freely, i.e., neither the closing device 10 nor the damper 20 exerts closing or opening forces on the door 2. This is because the closing device 10 is latched on the catch pawl 35 and remains stationary, while the damper 20 presses against the stop 42 and is also arranged in a stationary manner.

Figure 7:
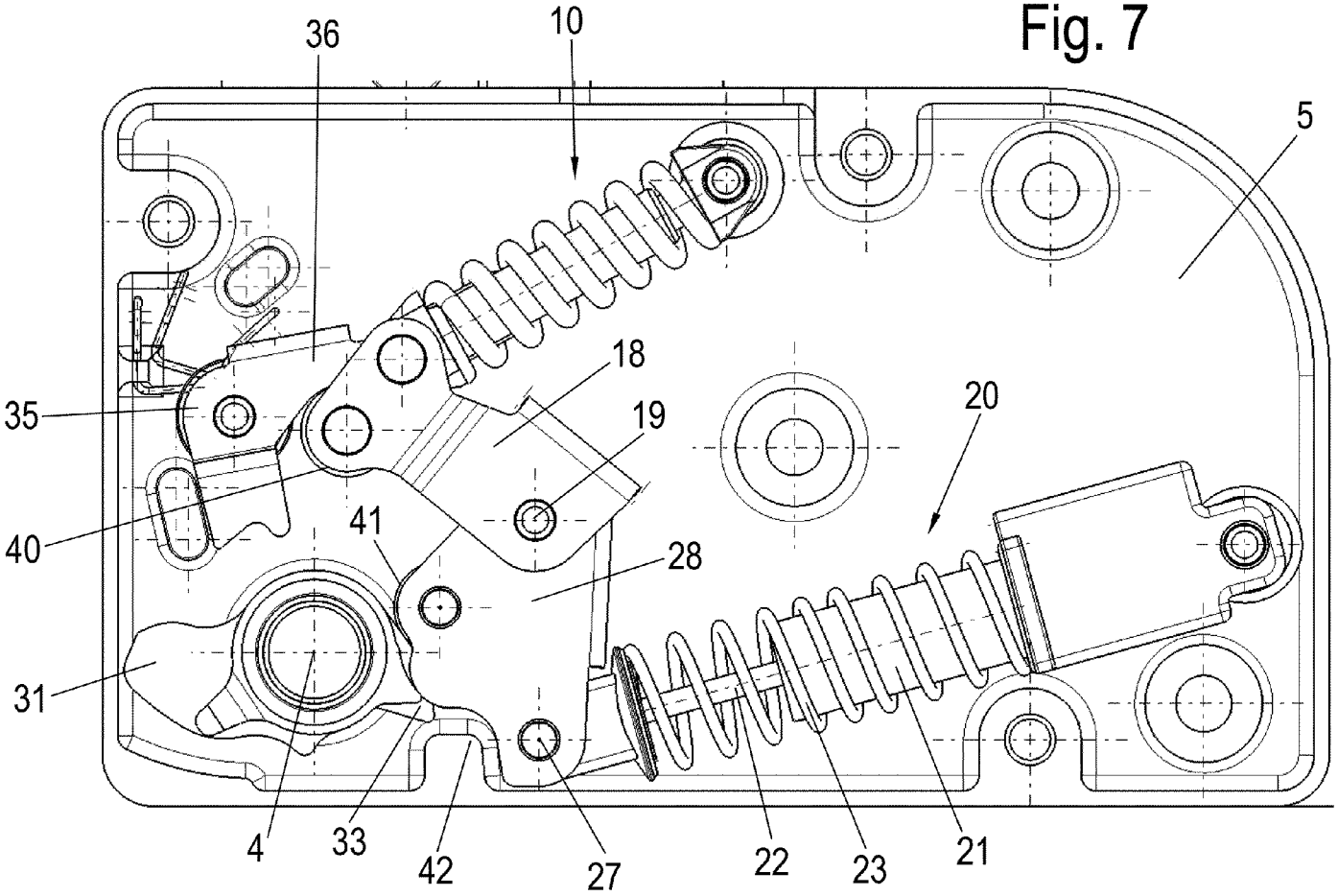
FIG. 7 shows a view of the bearing arrangement with the door open at a 155° angle.

If the door 2 is now moved further in the opening direction, a further control projection 33 of the curve guide 30 engages with the pivot part 28 and/or the roller 41 to rotate the pivot part 28 counterclockwise. The damper 20 is thus compressed and the piston rod 22 moves into the housing 21, whereby damping forces are generated. During a movement from an opening angle of approximately 155° (FIG. 7) up to the maximum opening position of approximately 180° (FIG. 8), the damper 20 is thus compressed. The closing device 10 is still in the latched position and therefore does not exert forces on the door 2. The maximum opening angle may be, for example, from 90° to 180°.

Figure 8:
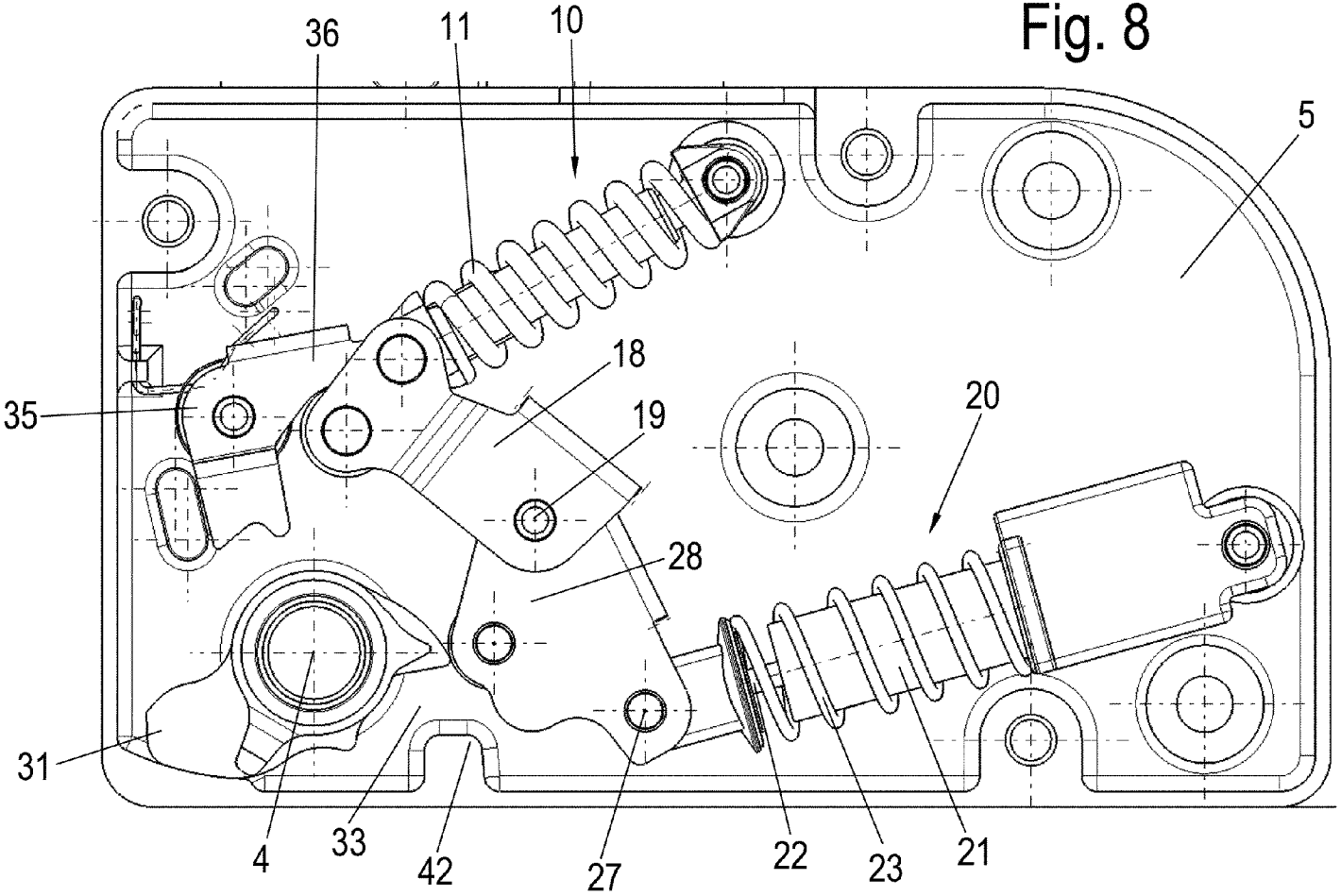
FIG. 8 shows a view of the bearing arrangement with the door open at a 180° angle.

If the door 2 is now moved out of the maximum opening position of FIG. 8 in the closing direction, firstly the damper 20 is moved away again from the compressed position, wherein the movement is performed by the spring 23, so that the user does not feel any forces due to the extension of the damper 20 during the closing of the door 2. The door 2 is now moved further in the closing direction until, at an opening angle of approximately 60° to 70°, the control projection 31 comes into contact with the roller 40 of the actuating part 18 and simultaneously the control curve 34 abuts the arm 37 of the catch pawl 35. By way of a minor compression of the spring 11 of the closing device 10 and a pivot of the catch pawl 35 by the control curve 34, the catch pawl can be moved into the unlocked position, in that the catch pawl 35 is pivoted about the axis 38 by the force of the spring 39.

If the door 2 is now moved further in the closing direction, at a closing angle between 20° and 60°, the control projection 31 engages with the roller 41 to pivot the pivot part 28 counterclockwise and thus move the damper 20 into the compressed position. Damping forces are thus also generated during the closing of the door 2. The closing device 10 is simultaneously active, since it was unlocked via the control curve 34, so that the spring 11 now rotates the actuating part 18 counterclockwise about the axis 19, wherein the roller 40 runs on the rear side of the control projection.

If the door 2 is closed beyond an angle of 0° as a result of manufacturing tolerances, it is possible using the bearing arrangement shown, wherein a further control projection 32 is provided for this purpose on the control curve, to keep the maximum closing forces small.

In the exemplary embodiment shown, the actuating part 18 of the closing device 10 and the pivot part 28 of the damper 20 are partially actuated via the same control projections 31, which form a shared control curve. Of course, it is also possible to provide two separate control curves on the bearing axis 4, wherein one control curve is exclusively responsible for the actuating part 18 and the second control curve is exclusively responsible for the pivot part 28. Furthermore, it is possible that the actuating part 18 and the pivot part 28 are not mounted via a shared axis 19. Each of these components can also have a separate axis.

The shape of the control projections 31, 32, and 33 can be adapted to the respective intended use. For example, it is possible to embody the damping forces as greater in an angle range shortly before reaching the maximum closing position than in an opening range between 20° and 30°. In addition, the spring 11 of the closing device 10 can be activated via the curve guide 30 so that the closing forces are kept low in the closed position, to keep the forces on the seals low, while the closing forces are embodied as greater in a slightly open range. Depending on the embodiment of the invention, the bearing axis 4 can be embodied as a separate bearing axis. That is to say, the bearing axis is already attached in the door during the mounting, for example, and the bearing arrangement is plugged onto the bearing axis, so that the bearing axis is indirectly connected to the curve guide.

Figure 9:
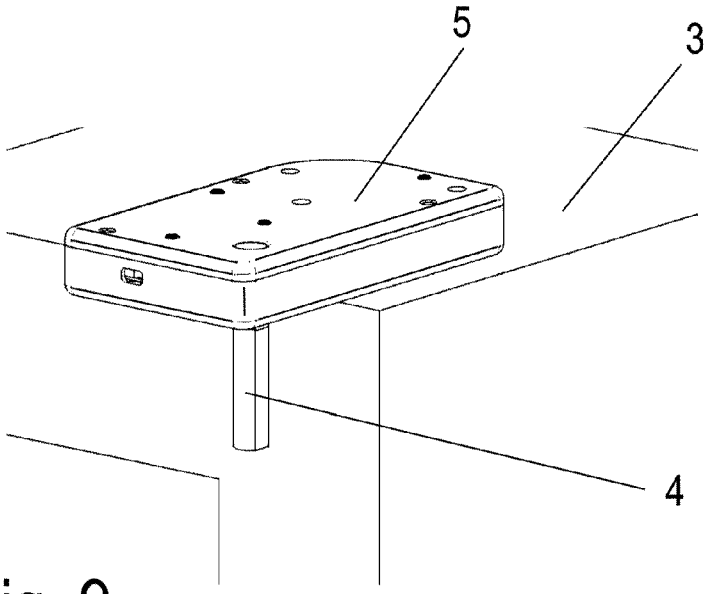
FIG. 9 shows a perspective view of the bearing arrangement on an upper side of a cabinet.

In FIG. 9, the bearing arrangement is mounted with the housing 5 on an upper side of a cabinet 3 and the bearing axis 4 protrudes downward. A door can then be mounted on the bearing axis 4 having non-circular cross-section, which is subjected to corresponding damping, opening, and closing forces by the bearing arrangement.

Figure 10:
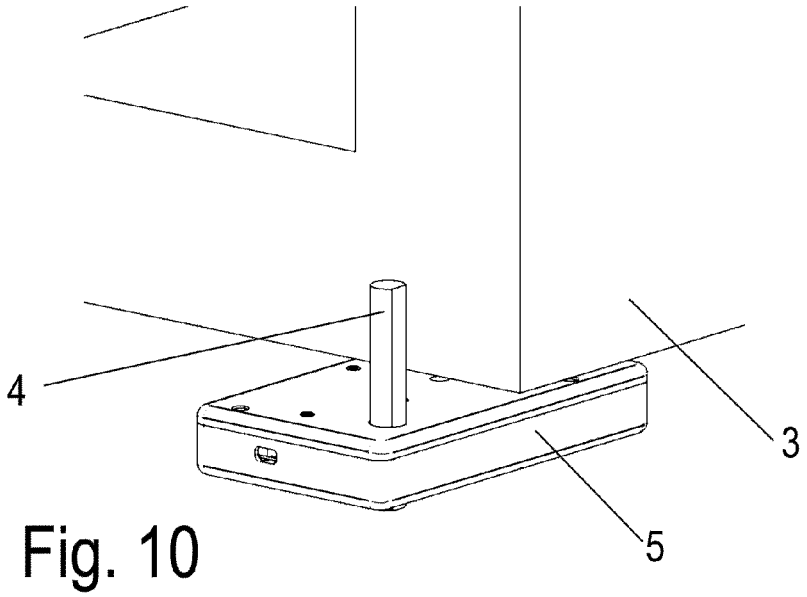
FIG. 10 shows a perspective view of the bearing arrangement, which is mounted on a lower side of a cabinet.

Furthermore, the bearing arrangement can also be mounted on a lower side of a cabinet, as shown in FIG. 10. A door is then mounted on the upwardly protruding bearing axis 4.

The bearing arrangement shown can be used on a right or left side of a cabinet 3, without special right or left components being required.

The invention claimed is:

1. A bearing arrangement for a door, the bearing arrangement having a bearing axis for rotatable mounting of the door, a closing device by means of which the door is movable by the force of a force accumulator over a specific pivot range in the closing direction, a damper for damping a pivot movement of the door over at least one pivot range, wherein the closing device and the damper are aligned in an essentially perpendicular plane in relation to the axis of rotation of the bearing axis, and first and second curve guides arranged indirectly or directly on the bearing axis, wherein the first curve guide is movable by the bearing axis and configured to actuate the closing device, the second curve guide is movable by the bearing axis and configured to actuate the damper both in the closing direction before reaching the closed position and also in the opening direction before reaching the maximum open position; and the damper is not actuated over a predetermined pivot range between the closed position and the open position.

2. The bearing arrangement according to claim 1, wherein the first and the second curve guides are connected in a rotationally-fixed manner to the bearing axis.

3. The bearing arrangement according to claim 1, wherein the first and second curve guides have control projections configured to act on the corresponding one of closing device and the damper.

4. The bearing arrangement according to claim 1, wherein the closing device and the damper are accommodated in a housing.

5. The bearing arrangement according to claim 4, wherein the damper is mounted so it is rotatable on the housing on one side and is held so it is rotatable on a pivot part on the opposite side.

6. The bearing arrangement according to claim 5, wherein the second curve guide has control projections which act on the pivot part or a roller or sliding element arranged on the pivot part.

7. The bearing arrangement according to claim 1, wherein the closing device force accumulator is a spring which is disposed between a first end piece and a second end piece.

8. The bearing arrangement according to claim 7 wherein one of the first and second end pieces is mounted so it is rotatable on the housing and the other of the first and second end pieces is arranged on a rotatably mounted actuating part.

9. The bearing arrangement according to claim 8, wherein the rotatably mounted actuating part is movable via at least one control projection on the first curve guide, wherein a rotatable roller or a sliding element can be provided on the actuating part, on which the at least one control projection acts.

10. The bearing arrangement according to claim 1, wherein a catch mechanism is provided to latch the closing device in a tensioned state when the door is open.

11. The bearing arrangement according to claim 10, wherein the catch mechanism has a catch pawl actuable by a control curve on the first or second curve guide.

12. The bearing arrangement according to claim 11, wherein the catch pawl is pre-tensioned by a catch spring in the position which releases the latching.

13. The bearing arrangement according to claim 1, wherein the damper is designed as a linear compression damper, which causes a higher damping force during compression than during expansion.

14. An appliance having at least one pivotable door, which is held on a cabinet via at least one bearing arrangement according to claim 1.

15. An appliance according to claim 14, wherein the bearing arrangement is fixed on an outer side of the cabinet.

16. The bearing arrangement of claim 7 wherein the spring is a compression spring.

17. The appliance of claim 14 being a refrigerator or freezer.

18. The appliance of claim 15 being a refrigerator or freezer.

* * * * *